US008790285B2

(12) United States Patent
Bisera et al.

(10) Patent No.: US 8,790,285 B2
(45) Date of Patent: Jul. 29, 2014

(54) ENHANCED CHEST COMPRESSOR

(75) Inventors: Joe Bisera, Camarillo, CA (US); Max Harry Weil, Rancho Mirage, CA (US); Wanchun Tang, Palm Desert, CA (US); Carlos Castillo, Cathedral City, CA (US)

(73) Assignee: Weil Institute of Critical Care Medicine, Rancho Mirage, CA (US)

( * ) Notice: Subject to any disclaimer, the term of this patent is extended or adjusted under 35 U.S.C. 154(b) by 1664 days.

(21) Appl. No.: 11/804,558

(22) Filed: May 18, 2007

(65) Prior Publication Data

US 2008/0287863 A1 Nov. 20, 2008

(51) Int. Cl.
*A61H 31/00* (2006.01)

(52) U.S. Cl.
USPC ..... 601/41; 601/97; 601/107

(58) Field of Classification Search
USPC ..... 601/41–44, 97, 101, 107, 108, 98
See application file for complete search history.

(56) References Cited

U.S. PATENT DOCUMENTS

| | | | | | |
|---|---|---|---|---|---|
| 2,970,592 | A * | 2/1961 | David | 606/238 |
| 3,289,672 | A * | 12/1966 | Thomas | 601/106 |
| 3,512,522 | A * | 5/1970 | Greenlee et al. | 601/106 |
| 3,610,233 | A * | 10/1971 | Barkalow | 601/106 |
| 4,088,128 | A * | 5/1978 | Mabuchi | 601/101 |
| 4,495,940 | A * | 1/1985 | Takaishi | 601/108 |
| 4,512,339 | A * | 4/1985 | McShirley | 601/108 |
| 4,549,535 | A * | 10/1985 | Wing | 601/108 |
| 4,669,454 | A * | 6/1987 | Shamos | 606/238 |
| 4,915,095 | A * | 4/1990 | Chun | 601/43 |
| 5,327,887 | A * | 7/1994 | Nowakowski | 128/204.21 |
| 5,639,074 | A * | 6/1997 | Greenhill et al. | 267/162 |
| 6,129,005 | A * | 10/2000 | Asadi et al. | 92/183 |
| 6,790,184 | B2 * | 9/2004 | Thierman | 600/553 |
| 6,976,969 | B2 * | 12/2005 | Messerly | 601/2 |
| 7,060,041 | B1 | 6/2006 | Weil et al. | |
| 2004/0030272 | A1 * | 2/2004 | Kelly et al. | 601/44 |
| 2005/0148909 | A1 * | 7/2005 | Weil et al. | 601/41 |
| 2005/0183911 | A1 * | 8/2005 | Wilda et al. | 188/322.15 |
| 2007/0150004 | A1 * | 6/2007 | Colloca et al. | 606/238 |
| 2007/0158154 | A1 * | 7/2007 | Bluemle et al. | 188/322.22 |

* cited by examiner

*Primary Examiner* — Justine Yu
*Assistant Examiner* — Christopher Miller
(74) *Attorney, Agent, or Firm* — Lawrence S. Cohen

(57) ABSTRACT

A chest compressor includes a piston (14) that moves in downward and upward strokes, with the piston undergoing a smooth reversal at the bottom of the downward stroke. A compression spring such as a wave spring (60), is positioned to engage the piston only near the end of its downward stroke, to smoothly reverse the piston motion, limit downward force on the patient at the end of the stroke, and avoid a downward pulse due to the momentum of the downwardly-moving piston. A stop (90, 92) is latchable in an inward position to allow reduction in the piston stroke by engaging an outward flange (56) on the piston before the piston has moved fully downward.

6 Claims, 2 Drawing Sheets

ENHANCED CHEST COMPRESSOR

BACKGROUND OF THE INVENTION

An automatic chess compressor can be carried by an emergency worker and applied to a patient to stimulate blood circulation and breathing. Such a chest compressor usually includes a piston that moves up and down in a cylinder (assuming that the patient is reclined so his chest faces upward). The cylinder is held closely over the patient's chest as by a strap wrapped around the patient's chest area. The chest compressions may occur at a frequency such as ½ to one second apart, so the piston moves downward rapidly in each stroke.

A rapidly downwardly-moving piston tends to impart a downward pulse to the patient at the bottom of the stroke, which is not desirable. It is possible to use a spring that is fixed to the piston to reduce the downward force as the piston moves down. However, the spring force applied along most of the piston movement tends to slow piston movement so additional energy is required to move the piston. A spring has the advantage of more rapidly raising the piston after each chest compression, but it is found that resilience of the chest is sufficient to rapidly raise the piston after each downward stroke.

In most cases, the patient's chest should be compressed by about one to two inches in each stroke, to benefit blood circulation and breathing while avoiding harm to the patient's chest (e.g. by breaking a rib). The piston actually must apply a downward stroke of about two to four inches to produce a patient chest compression of about one to two inches because the backup such as the strap wrapped about the patient, presses into the patient and takes up some of the compression. For children and small adults, it is desirable to reduce the chest compression to near the minimum, while for adults of normal to large size it desirable to use chest compressions close to the maximum. The chest compressor should be easily and rapidly convertible between different compression distances.

SUMMARY OF THE INVENTION

In accordance with one embodiment of the present invention, a chest compressor is provided of the type that comprises an actuator that includes a piston that moves vertically (when the patient's chest faces upward) to repeatedly compress the patient's chest, wherein piston motion is gradually reversed near the bottom of its downstroke while minimizing the energy absorbed to create such reversal. The piston moves during most of its downstroke without having to overcome the force of a spring that would slow its downward motion. A spring, such as a wave spring, first engages the piston near the bottom of its downstroke and at that time the spring rapidly slows downward motion of the piston and avoids a large downward force at the end of the stroke.

The length of piston stoke is easily varied by the emergency worker, so the stroke length can be changed for different patients. This is accomplished by providing one or more stops that can be moved into the path of the piston. In a telescoping piston arrangement wherein an outer piston part lies within an inner piston part, the stop(s) engage only the outer piston part. The compression spring that reverses piston movement, lies at the bottom of the outer piston part to engage an outward flange at the top of the inner piston part near the end of the piston downstroke.

The novel features of the invention are set forth with particularity in the appended claims. The invention will be best understood from the following description when read in conjunction with the accompanying drawings.

DETAILED DESCRIPTION OF THE INVENTION

Figure 1:
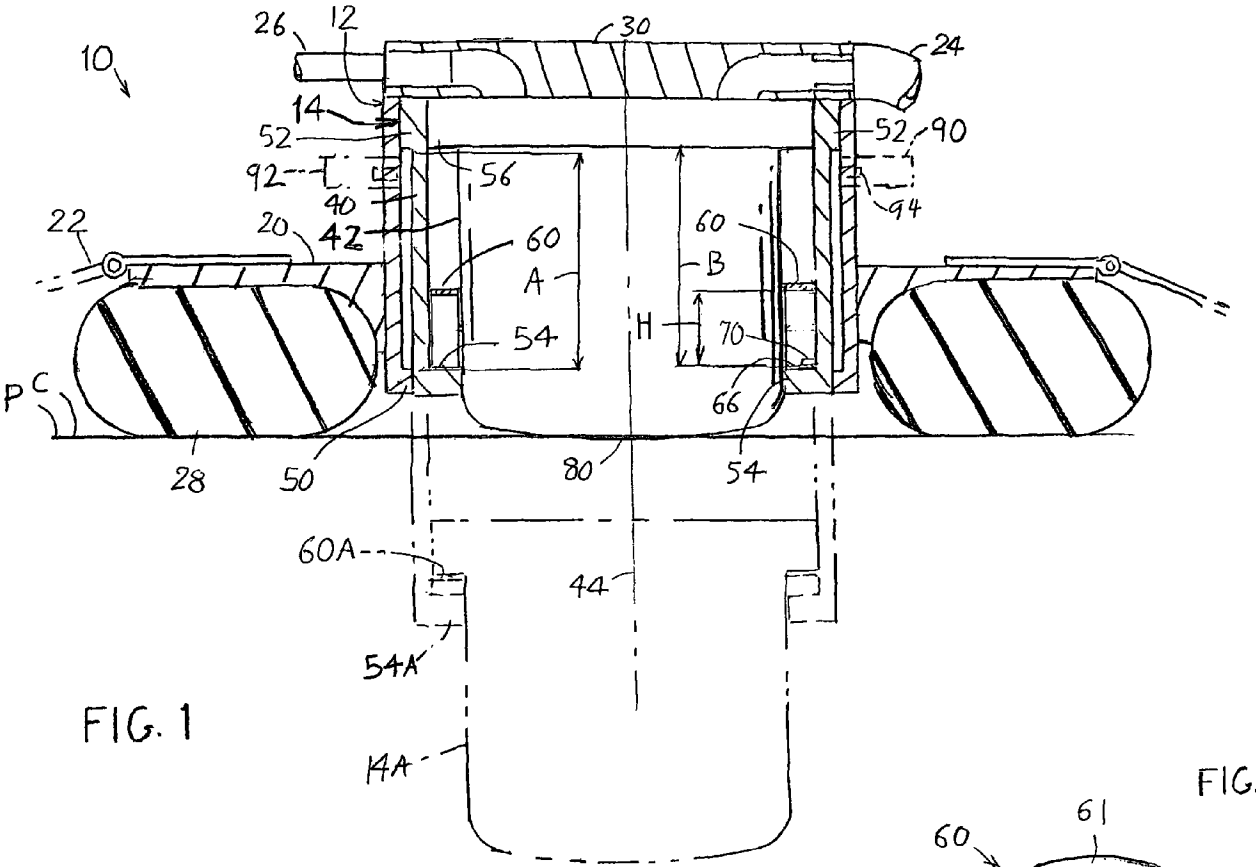
FIG. 1 is a sectional view of a chest compressor of the present invention showing stops in phantom lines.

FIG. 1 illustrates a chest compressor 10 mounted on a patient P to repeatedly compress the patient's chest C. The chest compressor includes a cylinder 12 (which is not necessarily cylindrical) whose function is to guide a piston 14 in vertical movement. In the following discussion it is assumed that the patient lies in a reclined position with his/her chest facing upward. A frame 20 is attached to the cylinder and it holds a strap 22 that encircles the patient's upper torso and holds a stabilizer 28 that resists tipping. The piston repeatedly moves from an upward position shown at 14 to a downward position shown at 14A, at a rate such as a stroke every ½ to one second.

In the chest compressor illustrated, the piston 14 is moved downward by compressed fluid such as compressed air or oxygen that flows through a control into the cylinder though a tube 24 and out though another tube 26, both tubes being connected to a top plate 30 of the cylinder. Applicant finds that sufficiently rapid upward movement is produced by the resilience of the patient. Means other than compressed gas can be used to move the piston up and down, including an electrically powered mover such as a solenoid or motor(s).

The piston illustrated in FIG. 1 is a telescoping piston which includes a plurality of piston parts that lie one within the other, with first and second, or outer and inner piston parts 40, 42 being shown. The piston has an axis 44. The cylinder has a radially inwardly-projecting (with respect to the axis 44) flange 50 at its bottom. The outer piston part 40 has top and bottom flanges 52, 54, and the inner piston part 42 has a top flange 56. When the piston reaches nearly its lowest position at 14A, the inner piston flange 56 approaches the outer piston part lower flange at 54A. If there were no spring to slow the downward movement of the inner piston part near the end of the downward stroke, the downward momentum of the inner piston part would result in an extra downward pulse applied to the patient, which might injure the patient without increasing blood circulation or breathing.

Figure 2:
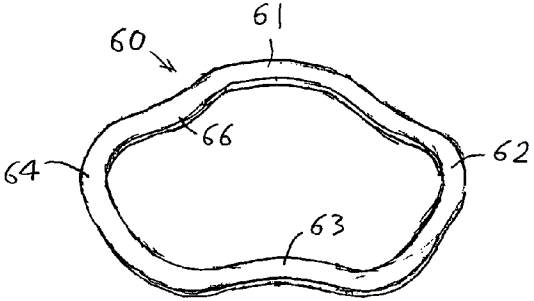
FIG. 2 is an isometric view of a wave spring of the chest compressor of FIG. 1.

In accordance with one aspect of the invention, applicant positions a compression spring 60, in the form of a wave spring, in the path of the inner piston part 42. The wave spring 60 shown in FIG. 2, has four raised parts 61-64 and four corresponding lower parts 66 between the raised parts. FIG. 1 shows that the spring lower parts 66 rest on the bottom flange 54 of the outer piston part and the spring is preferably held thereagainst as by adhesive or by a holddown 70. Although the wave spring is of small radial width, the bottom flange 54 of the outer piston part is provided with a larger radial width than the cylinder bottom flange, to hold the wave spring.

In normal operation, the outer piston part 40 moves downward until its top flange 52 is stopped by the cylinder flange 50, and the inner piston part has begun to move down within the outer piston part. The inner piston part top flange 56 engages the wave spring 60 and compresses it against the outer piston part bottom flange 54. Such compression of the wave spring as to 60A, slows downward movement of the inner piston part to avoid a large force at the end of piston downward movement, and even helps reverse the piston direction of motion. In the prior art, springs were provided that were continuously connected to the piston to continually urge it upward. As a result, greater energy (e.g. higher pressure air) was required to rapidly move the piston in a full downward stroke. In the present invention, the compression spring engages the piston to slow its downward movement only near the end of downward piston movement, so energy is absorbed from the piston only along a small portion of its stroke.

FIG. 1 shows that the outer piston part has a stroke length A between its upward position and a position where its top outer flange 52 is stopped by the cylinder flange 50. The inner piston part has a maximum stroke length B between its top flange 56 lying against the top plate and its top flange 56 fully compressing the wave spring against the outer piston part flange 54. (The outer piston part can be provided with an internal flange to assure that the inner piston part always lies below the top of the outer piston part). The lengths A and B are each about two inches, and the distance A+B is about four inches. The wave spring has an uncompressed height H that is about 20 millimeters (about 0.8 inch). Therefore, the wave spring does not engage and begin slowing the inner piston part top flange 56 until the outer piston part has moved down completely (about 2.0 inches) and the inner piston part has moved down along a partial stroke length (2 inches−0.8 inch=1.2 inch) so the complete piston has moved down 3.2 inches out of a maximum stroke length of 4.0 inch.

Figure 3:
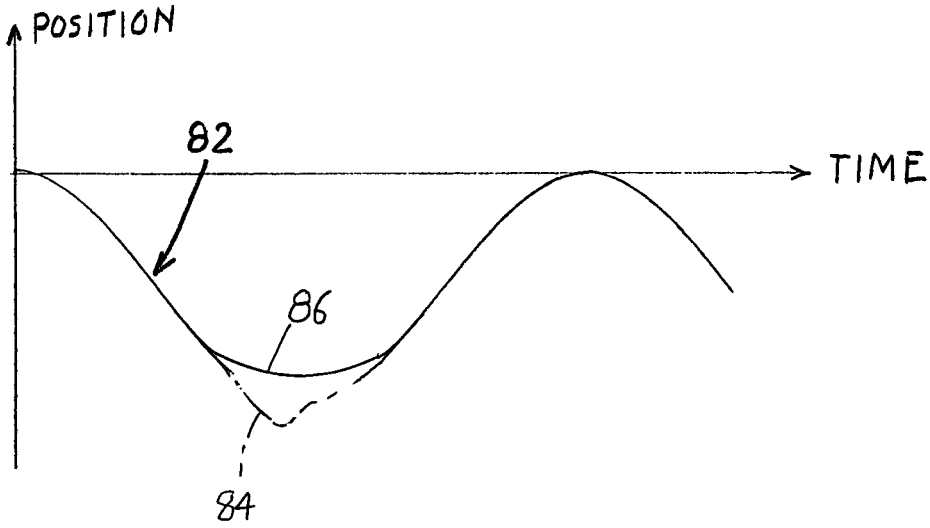
FIG. 3 is a graph showing an idealized path of a piston of the invention, and showing how the momentum of the piston could produce a pulse in the absence of the spring of the present invention.

FIG. 3 is an idealized graph 82 of motion of the bottom 80 of the piston, with the piston moving down and up about every one-half to one second. Without the wave spring, the momentum of the rapidly moving piston inner part would produce a short pulse at 84 that might harm the patient as by breaking a rib, and which is such a short pulse that it creates no appreciable increase in blood circulation or breathing. With the wave spring, the bottom of the piston follows the path indicated at 86, which produces a more gradual reversal.

As mentioned above, a combined piston stroke of about four inches is desirable for full size adults, while a piston stroke of about two inches is desirable for a child or small adult. The emergency worker can rapidly decide the length of piston stroke that is appropriate for a particular patient. Applicant allows the emergency worker to quickly adjust the stroke length by providing at least one pair of stops 90, 92 (FIG. 1). Each stop includes a pin 94 that is mounted on a double click mechanism, of the type used in pens to project and retract the pen tip. When the emergency worker first pushes in the stop 90, the pin is latched (temporarily held) in the inward position wherein the pin lies in the path of the top flange 52 of the outer piston part Then the outer piston part cannot move down below the pin and the combined downward stroke length is about 2 inches (with the spring slowing the stroke near its bottom). Another pair of such stops can be provided at a lower location to allow only about one inch of outer piston part movement to limit the stoke length to three inches.

Figure 4:
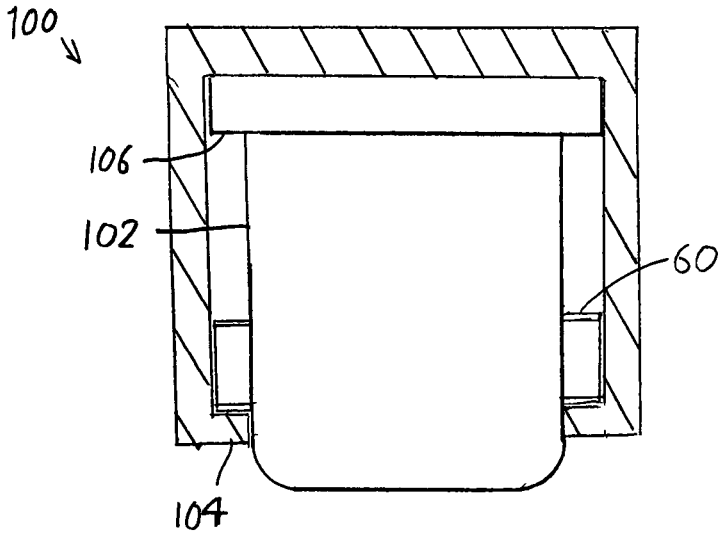
FIG. 4 is a sectional view of a chest compressor of another embodiment of the invention which includes only one piston part.

FIG. 4 shows a chest compressor actuator 100 with a single piston part 102. The wave spring 60 rests on an internal flange 104 of the actuator and is compressed by an external flange 106 of the piston part 102 of the actuator piston, only after about two-thirds of the total downward stroke.

Thus, the invention provides a chest compressor of the type in which a piston moves up and down (relative to a patient with an upwardly facing chest), wherein a spring is provided that engages the piston to slow its downward movement during a downward stroke, only after the piston has completed a majority of its downward stroke. The spring is preferably a compression spring, and is preferably a wave spring. The spring is useful for a chest compressor having a piston with only one piston part, or a piston with a plurality of telescoping piston parts. The downward stroke can be reduced from its maximum, by providing one or more stops that are moveable into the path of an outward flange of a piston or piston part, to prevent the piston or piston part from moving down along its full downward stroke.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for use by an emergency worker for applying compressions to the chest of a patient to enhance breathing and blood circulation, which comprises:

a cylinder (12) and a piston (14) that is movable in the cylinder in repeated upstrokes away from the patient, including:

a spring (60) that engages said piston, to slow its downward movement and reduce its downward force and reverse piston movement, only when the piston has completed at least two-thirds of its downstroke, said spring having a sufficient diameter to not only slow piston downward movement but to help reverse piston movement to begin an upstroke.

2. The apparatus described in claim 1 wherein:

said piston has a part with an outward flange (52) and said apparatus has an inward flange (54) lying below said piston outward flange to leave an annular region (60) between the flanges, and said spring means is a wave spring that lies between said flanges to start to be compressed near the end of the piston downstroke.

3. The apparatus described in claim 1 wherein:

said piston includes a piston part that is guided in sliding movement by said cylinder along a path of a first length that extends along a downstroke and including;

a stop (90) that is moveable from a nonlimiting location to a limiting location that lies in the path of said piston part, with the stop being latchable in said limiting location to reduce the length of downstroke movement of the piston part along each downstroke while not preventing said downstroke.

4. Apparatus for applying chest compressions to a patient, which comprises:

an actuator comprising a cylinder (12) and a piston (14) with a piston part that is actuatable to move in a downstroke towards the patient and an upstroke away from the patient, including:

a stop (90) that is moveable between a first location, to a limiting location that lies in the path of the piston part to reduce the length of the piston downstroke, said stop being latchable in said limiting location, wherein:

said piston part has an axis and has an outwardly-extending flange (52) that moves up and down, and said stop comprises a pin (94) that is moveable radially inward to said limiting location wherein said pin lies in the path of said outwardly-extending flange, said pin being moveable outward to said first location;

said stop includes a double click mechanism that latches said pin in said limiting location, and that latches said pin in said first location when the pin is pressed radially inward from said first location so the pin moves to said limiting location.

5. The apparatus described in claim 4 including:

a first compression spring (60) that lies in the path of said piston and that is positioned to engage said piston only after said piston has moved more than half a distance of a downward stroke of said piston during its downward stroke, and to slow and reverse movement of the along a height (H) of at least about 20 millimeters, said first compression spring being the only spring that applies a force to said piston.

6. The apparatus described in claim 1 wherein:

said compression spring comprises at least one wave spring which has opposite sides and which has a horizontal width as measured between said opposite sides, and which has a vertical height smaller than said horizontal width.

* * * * *